United States Patent [19]

Ausnit

[11] Patent Number: 4,578,813

[45] Date of Patent: Mar. 25, 1986

[54] BAG AND RECLOSABLE SEPARABLE FASTENER ASSEMBLY PROVIDING BOTH CLOSING ALIGNMENT FACILITY AND DIFFERENTIAL SEPARATION RESISTANCE

[75] Inventor: Steven Ausnit, New York, N.Y.

[73] Assignee: Minigrip Incorporated, Orangeburg, N.Y.

[21] Appl. No.: 619,187

[22] Filed: Jun. 11, 1984

[51] Int. Cl.[4] ..... B65D 33/16

[52] U.S. Cl. ..... 383/65; 383/63

[58] Field of Search ..... 383/63, 64, 65; 24/17 AP, 30.5 R, 30.5 P, 487

[56] References Cited

U.S. PATENT DOCUMENTS

| | | | |
|---|---|---|---|
| Re. 28,969 | 9/1976 | Naito | 150/3 |
| 2,780,261 | 2/1957 | Svec et al. | 150/3 |
| 3,054,434 | 9/1962 | Ausnit et al. | 150/3 |
| 3,246,672 | 4/1966 | Naito | 383/63 |
| 3,338,285 | 8/1964 | Jaster | 383/65 |
| 3,372,442 | 3/1968 | Ishimatsu | 24/201 |
| 3,389,733 | 6/1968 | Siegel | 150/3 |
| 3,416,199 | 12/1968 | Imamura | 383/63 |
| 3,416,585 | 12/1968 | Staller | 150/3 |
| 3,425,469 | 2/1969 | Ausnit | 150/3 |
| 3,633,642 | 1/1972 | Siegel | 150/3 |
| 3,654,049 | 4/1972 | Ausnit | 383/63 |
| 3,827,472 | 8/1974 | Uramoto | 383/63 |

FOREIGN PATENT DOCUMENTS

| | | | |
|---|---|---|---|
| 1112446 | 8/1961 | Fed. Rep. of Germany | 383/63 |
| 2037704B | 5/1983 | United Kingdom . | |

*Primary Examiner*—Joseph Man-Fu Moy
*Assistant Examiner*—David Fidei
*Attorney, Agent, or Firm*—Hill, Van Santen, Steadman & Simpson

[57] ABSTRACT

A fastener assembly has two sets of fastener profile elements for a reclosable bag especially adapted for mutually facilitating alignment and interlocking closure interengagement of said fastener profile elements responsive to closing pressure applied from outside of the bag toward the fastener assembly.

Further, the fastener assembly is so constructed that a lower portion of the fastener assembly effectively resists opening separation from the interlocking interengagement thereof by separating forces exerted on the wall panels of the bag from inside of the bag body, while the upper portion of the fastener assembly is adapted to be relatively easily separated by pulling apart pull flanges extending thereabove, and such pulling apart of the pull flanges sequentially thereafter being adapted to pull apart the lower portion of the fastener assembly for access through the mouth of the bag into the interior of the bag.

16 Claims, 4 Drawing Figures

BAG AND RECLOSABLE SEPARABLE FASTENER ASSEMBLY PROVIDING BOTH CLOSING ALIGNMENT FACILITY AND DIFFERENTIAL SEPARATION RESISTANCE

BACKGROUND OF THE INVENTION

1. Field of the Invention

This invention relates to the art of reclosable bags of the type generally fabricated from plastic film, and is more particularly concerned with a new and improved reclosably separable resiliently flexible extruded plastic fastener profile assembly for such bags.

Bags of the type indicated are in widespread use for enveloping contents retained in the bags by means of the separable and reclosable fasteners at the top, or mouth ends, of the bags and providing convenient means for access into the bags when desired.

Separable fasteners have attained a considerable degree of development. One common construction consists of a single rib and groove assembly having a generally asymmetric arrowhead shaped cross-section male fastener member on one wall of the bag and a complementary grooved female profile on the opposite wall having hook shaped structure interlockable with the arrowhead shaped profile. A problem with such a single rib and groove fastener profile structure is that unless the structure has a certain size or stiffness and is manufactured to fairly exacting dimensions some difficulty is often encountered in effecting registration of the complementary profiles in fastener closing maneuver thereby making the fastener more difficult to interlock. On the other hand, this type of fastener structure has the advantage that the profile elements can be easily and economically provided with a construction that retains the fastener securely against opening due to internal pressures within the bag, such as may be caused by air or the contents in the bag that exert separating force on the bag walls, and nevertheless, can be readily opened from the outside by pulling the same apart as by means of pull flanges which extend outwardly at the mouth of the bag.

In another form of separable fastener there is provided a plurality of parallel interlockable hook shaped ribs, which even in a relatively very small size and relatively soft and resiliently flexible material can be readily aligned for closing by simple inward pressure. However, this type of separable fastener does not lend itself readily to resistance against internal pressure, and has heretofore required a supplementary expedient such as hingedly connecting one of the fastener profiles to overcome the problem.

2. Prior Art

The following U.S. patents are referred to as exemplary of the present state of the art:

U.S. Pat. No. Re. 28,969—shows a single arrowhead profile and complementary groove profile and with a structure at the side of the fastener facing toward the inside of the bag to resist separation due to internal outward pressures on the sidewalls.

U.S. Pat. No. 3,416,585—another example of a single rib and groove arrangement with structure to resist opening of the fastener from internal pressures.

U.S. Pat. No. 3,389,733—a further example of single rib and groove arrangement with means to resist opening of the fastener from internal pressures.

U.S. Pat. No. 3,425,469—still another example of a single rib and groove fastener structure having means to resist opening from the inside of the bag.

U.S. Pat. No. 3,372,442—shows an arrangement wherein a single arrow shaped profile is partially split and receives a wedge shaped prong rib projecting from the root of the grooved profile, and the structure being such as to resist opening due to internal pressures in the bag.

U.S. Pat. No. 3,633,642—aims to attain equal opening of the fastener from either inside or outside and provides fairly massive pull flange areas on which the fastener profiles are carried.

U.S. Pat. Nos. 2,780,261 and 3,054,434—show arrangements of fastener profile sections each comprising a plurality of ribs and grooves, and wherein one of the profile sections is carried on a hinge attached to the adjacent bag wall to afford expansion capability of the bag without separating the fastener due to internal pressures. These patents are representatives of numerous patents showing similar hinged mounting of one of the fastener profile sections.

SUMMARY OF THE INVENTION

There is, nevertheless, still room for improvement in spite of the demonstrated fairly high state of development in this art, and more particularly to the attainment of a reclosably separable extruded plastic fastener structure having the advantages of a multi-rib and groove arrangement to facilitate alignment and interlocking interengagement of the fastener profiles by closing pressure applied to the fastener profiles, and which will also have the desirable attributes of efficiently resisting internal pressures within the bag which might cause unintended opening of the fastener, and without resorting to a more complex and difficult to manufacture hinge type concept. It is to the attainment of such a desirable fastener construction in an economical, highly efficient form that the present invention is directed.

To this end, the present invention provides for a reclosable bag having a pouch body including opposite wall panels with surfaces facing toward each other and extending between a bottom edge, opposite sides and an openable top, a reclosably separable fastener assembly adapted to be located at lower end portions of upward extensions from said wall panels and which extensions serve as pull flanges for separating said fastener assembly to gain downward access to the inside of the bag, said fastener assembly comprising two complementary interengaging sets of spaced parallel, rib like resiliently flexible extruded plastic separable fastener profile elements provided with interlockable hooks arranged to extend across said wall panels at said facing surfaces and between said side edges, and with a first set on one of said wall panels and a second set on the other wall panel; each of said sets of fastener profile elements having a plurality of said profile rib like elements and a plurality of complementary intervening grooves for receiving the profile rib elements of the other set in separably interlocking relation, and said profile elements of each set being especially cooperatively related for mutually facilitating alignment and interlocking closure interengagement by closing pressure applied from outside of the bag wall panels toward said fastener assembly; lower cooperative portions of said sets of fastener profiles having means for strong resistance to opening from the inside of the bag; and upper cooperative portions of said sets of fastener profile elements, being arranged for relatively easier opening from the top of the bag by separating manipulation of said pull flanges.

In the described fastener assembly the first profile set includes a male profile element of multi-hook arrow shape cross-section that is received between a pair of complementary upper and lower monohook female profile elements of the second profile set, the male profile element and the female profile elements having respective complementary interlockable hooks. The upper female profile element has an upwardly facing back surface. The cooperating hooks of the lower female element and of the male profile element are constructed for effectively resisting opening from their interlocking interengagement by separating forces exerted on the wall panels from inside of the associated bag body. The profile sets have additional complementary monohook profile elements located above the male and female profile elements. One of the profile elements of the first set projects in overlying relation to the upper female profile element and has a downwardly facing back surface in back-to-back relation to the back surface of the upper female profile element. The monohook profile elements of both of the profile sets are mutually interlockingly engageable and adapted for relatively easy opening separation from their interlocking interengagement by bag opening manipulation of the pull flanges of the bag, so that when the pull flanges are pulled apart the interlocking monohook profile elements will be separated initially, and then by further pulling apart of the pull flanges the interlocking male and female profile elements will be separated for access through the bag top to the interior of the bag.

Stated another way, the fastener assembly has interengaging first and second sets of fastener profiles wherein the first set includes a double hook asymmetrical arrow-shaped profile element, and a first monohook profile element spaced upwardly from the double hook profile element, each of the double hook profile element and the monohook profile element having a hook directed upwardly, the arrow-shaped profile element having a larger hook on its lower side then the hook on its upper side. The second set of profile elements provides a groove-shaped formation for receiving the arrow-shaped fastener profile element and has opposed hooks which are complementary to and separably interengageable with the hooks of the arrow-shaped fastener profile element. A second monohook profile element of the second set is located above the groove-shaped fastener formation and has a hook directed downwardly to engage the hook of the first monohook profile element of the first set. The groove-shaped fastener formation has a surface which faces upwardly and is in face-to-face relation to a surface facing downwardly on the first monohook profile element of the first set. This provides an efficiently compact arrangement.

BRIEF DESCRIPTION OF THE DRAWINGS

Other objects, features and advantages of the present invention will be readily apparent from the following description of a representative embodiment thereof, taken in conjunction with the accompanying drawing, although variations and modifications may be effected without departing from the spirit and scope of the novel concepts embodied in the disclosure, and in which.

DETAILED DESCRIPTION

Figure 1:
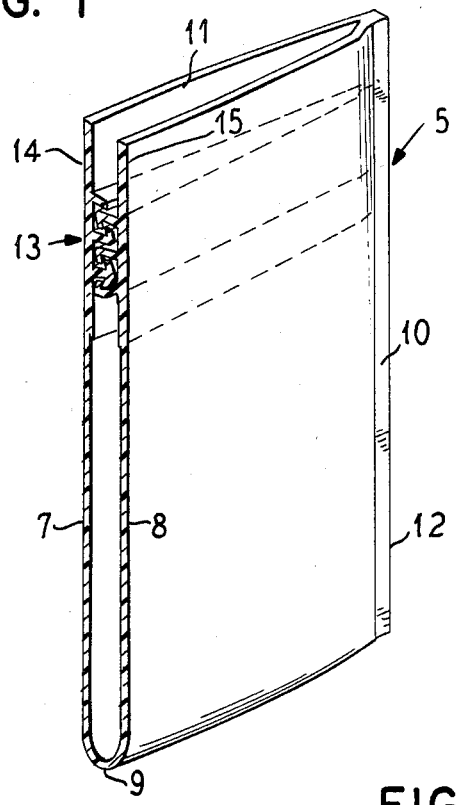
FIG. 1 is a fragmentary perspective view of a bag having reclosable separable fastener structure embodying the present invention.

A bag 5, the elements of which are shown in somewhat exaggerated detail for illustrative purposes in FIG. 1, is desirably fabricated from a suitable plastic film or sheet material, as is common in this art. The bag 5 has a pouch body including opposite wall panels 7 and 8 having surfaces which face toward each other and extend between a bottom 9, opposite side edges 10 and a top 11. Although only one of the side edges 10 is shown, it will be understood that the opposite side edge may be of the same structure. Each of the side edges 10 may, as shown, be closed by a heat seal 12. While the bottom 9 is shown as simply a fold, it may also, if preferred, comprise a heat seal similar to the side seals 12.

The bag top 11 provides an access opening or mouth which is adapted to be closed by a separable reclosable fastener assembly 13 which may be located at the lower end portions of upward extension 14 and 15 from the side walls 7 and 8, respectively. The upward extensions 14 and 15 are adapted to serve as pull flanges for opening of the fastener assembly 13. In this instance, for maximum strength and resistance to repeated manipulation, the pull flange extensions 14 and 15 may be of a thicker section then the side wall panels 7 and 8 therebelow.

For attainment of the desirable attributes of the present invention, the fastener assembly 13 comprises two sets of complementary interengaging sets of parallel, rib-like resiliently flexible extruded plastic separable fastener profile elements, a first set being on the wall panel 7 and the other set being on the wall panel 8 and the profile elements extending across the wall panels between the side edges 10. As shown, the sets of profile elements have been attached by integrally extruding them with or integrally fusing than at extrusion to the inside surfaces of the wall panels 7 and 8 and the pull flanges 14 and 15. If preferred, however, the sets of profile elements may be preformed and subsequently attached in any preferred manner, adhesively or by fused attachment, to the upper portions of the inside surfaces of the wall panels 7 and 8 either at the lower end portions of the upward extensions 14 and 15 as shown, or to the wall panels and coextensive therewith or to provide upward extensions from the wall panels. Such means of attachment are known alternatives in this art.

As will be described in greater detail hereinafter, one of the special attributes of the fastener assembly 13 of the present invention resides in that the two cooperatively related sets of profile elements are particularly well adapted for mutually facilitating alignment and interlocking closure interengagement by closing pressure applied from outside of the bag wall panels toward the fastener assembly.

In addition to the closing alignment attribute of the fastener assembly 13, means are provided for strong resistance to opening from the inside of the bag and the fastener assembly is relatively easily opened from the top of the bag by separating manipulation of the pull flanges 14 and 15. Thus, the upper portion of the fastener assembly identified by the bracket 17 in FIG. 2 is constructed and arranged for relatively easy opening from the top, while the lower portion of the fastener assembly identified by the bracket 18 is constructed and arranged for strong resistance to opening from the inside of the bag.

Figure 2:
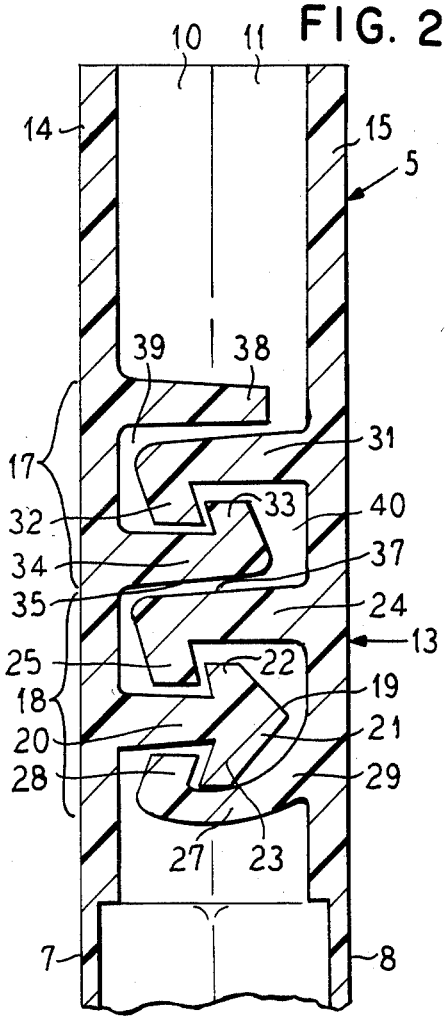
FIG. 2 is an enlarged vertical sectional view showing the fastener structure in enlarged detail.

The profiles of the lower portion 18 of the fastener assembly 13, and which are constructed for effectively resisting opening separation from the interlocking engagement shown in FIG. 2 by separating forces exerted on the wall panels 7 and 8 from inside the bag body, comprise an elongated generally arrowhead shaped male fastener profile rib 19 having a stem 20 arranged to be attached at the inside of the lower portion of the panel extension 14. The profile 19 projects toward the lower portion of the panel extension 15 and carries a generally triangular head 21 with a lateral hook flange 22 along its upper side and a lateral hook flange 23 along its lower side.

A hooked female fastener element 24 located above and adjacent to the fastener profile element 19 projects from the lower portion of the panel extension 15 toward the panel extension 14 and has a generally downwardly directed hook flange 25 on its distal end for cooperative interlocking with the upper hook flange 22 of the male fastener element 19. At the lower side of the fastener element 19 a hooked female fastener element 27 extends from the panel extension 15 toward the panel extension 14 and has at its distal end a generally upwardly directed hook flange 28 which cooperates for interlocking relation with the hook flange 23 of the male fastener element 19. The female fastener elements 24 and 25 between them define a grooved profile structure within which the male fastener profile element is receptive in the closed fastener relationship.

It should be observed that the hook flange 23 of the fastener profile element 19 is of substantially greater mass, and thus stiffness than the hook flange 22 of such fastener element, and that the hook flange 28 of the element 27 may also be provided with substantial mass, so that the interlocked hooks 23 and 28 will afford substantial resistance to separation due to internal forces within the pouch of the bag 5, that is, internal forces which may tend to push the wall panels 7 and 8 apart. Further, to assist in the resistance to internal force separation of the hook flanges 23 and 28, the fastener element 27 is of curvate cross-section, providing a concavity in which the interlock hook flange 23 of the element 19 is received, and extending from a base juncture 29 at the panel extension 15, so that there is minimum stress tending to separate the fastener element 27 from the element 19 when the wall panel 8 may bow outwardly under internal pressure within the bag. Nevertheless, both of the elements 24 and 27 are relatively resiliently flexible for enabling fastener closing relative movement of the elements 24 and 27 past the fastener element head 21 during fastener closure manipulation. After alignment of the fastener elements as shown in FIG. 3, closing pressure applied from opposite sides as indicated by the arrows 30 in FIG. 4, will cause the hook flanges 25 and 28 to cam past the hook flanges 22 and 23 until the hook flanges 25 and 28 clear the hook flanges 22 and 23 and the resilience of the elements 24 and 27 causes the hook flanges 25 and 28 to snap into interlocking position behind the hook flanges 22 and 23, as shown in FIG. 2.

In a preferred construction of the upper portion 17 of the fastener assembly 13, it comprises a monohook fastener element 31 projecting from the panel extension 15 toward the panel extension 14 and having at its distal end a generally downwardly projecting hook flange 32 which is interlockingly cooperative with a generally upwardly projecting hook flange 33 on a monohook fastener element 34 which projects from the panel extension 14 toward the panel extension 15. In the preferred arrangement, the fastener element 34 is located with its back 35 in back-to-back relation to back 37 of the fastener element 24 in a mutually supportive but separable relation. In addition, there is desirably provided a backup flange 38 extending from the wall panel extension 14 toward but short of the wall panel extension 15 and overlying the fastener element 31 in backup relation. In effect, the fastener element 34 and the flange 38 define a pocket or socket groove 39 within which the fastener element 31 is received. Similarly, the fastener element 31 and the back 37 of the fastener element 24 provide a pocket or socket groove 40 within which the fastener element 34 is received.

Figure 3:
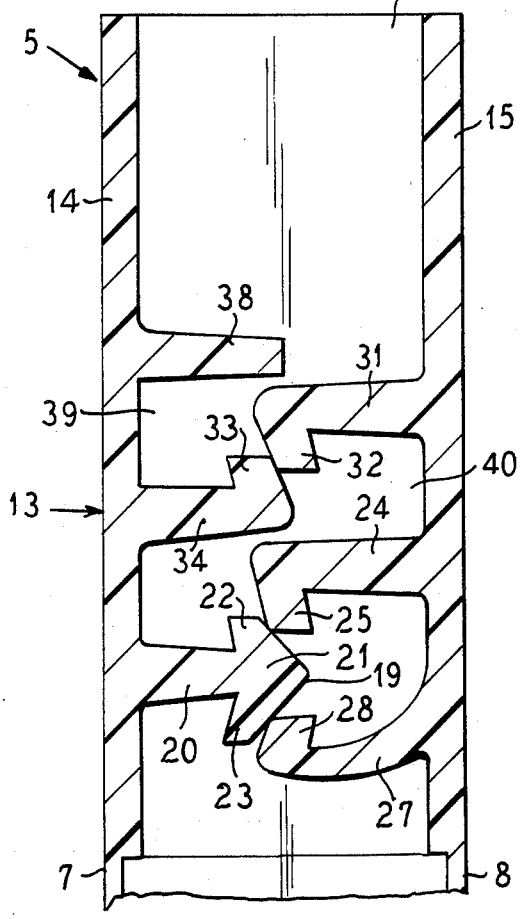
FIG. 3 is a view similar to FIG. 2 demonstrating how the profiles of the fastener cooperate for facilitating alignment or registration of the fastener profiles during a fastener closing maneuver.
Figure 4:
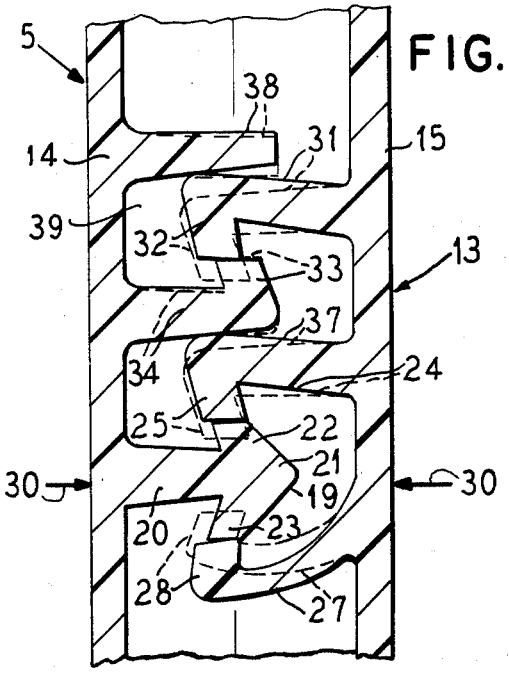
FIG. 4 is a similar view demonstrating interaction of the fastener profiles as the profiles are pressed toward one another for interlocking the profiles.

When maneuvering to close the fastener assembly 13, the fastener elements 31 and 34 assist in the fastener closing registration or aligning relation as shown in FIG. 3, at the same time that the hook flanges 25 and 28 of the fastener assembly 18 engage in such relation with the head 21 of the fastener element 19. It will be appreciated that in actual practice the sets of fastener profile elements of the assembly 13, i.e. the first set carried by the wall panel 7 and the second set carried by the wall panel 8, may be of relatively small size, so that the multiple alignment guidance cooperatively provided by the several fastener elements of the two sets of fastener profile elements greatly facilitate the fastener closing procedure. Such closing procedure then continues, as fastener closing pressure 30 is applied, by relative flexing of the flexible fastener elements 24, 27, 34, 31 and 38, as shown on comparison of the full line and dash line positions in FIG. 4, as the several hook flanges pass by one another in the two sets of fastener profile elements and until the hook flanges snap behind the cooperating hook flanges of the companion fastener profile elements. Then the several flexible fastener profile elements assume their normal unflexed positions in the interlocked, fastener closed relation as shown in FIG. 2.

Although the lower portion 18 of the fastener assembly 13 is so constructed and arranged that there is efficient, substantially assured resistance against separation due to internal pressures within the pouch of the bag 5, and the upper portion 17 of the fastener assembly, together with the lower portion 18 will maintain an effective closure of the bag pouch, opening of the bag when desired is easily effected. That is, when the pull flanges 14 and 15 are pulled apart, the interlocking profiles of the upper fastener assembly portion 17 will be separated initially, and then by further pulling apart of the pull flanges the interlocking profiles of the lower fastener assembly portion 18 will be separated for access into the interior of the pouch body.

It will thus be apparent that the present invention provides an advantageous, especially convenient and efficient reclosable separable fastener arrangement providing a unique combination of features which have not heretofore been available in this desirable combination. Not only does the fastener profile arrangement provide for assured alignment and registration of the fastener elements during a bag closing maneuver; but the fastener profile arrangement provides for multiple fastener securement, and substantially assured resistance to opening of the fastener due to internal pressures within the pouch of the bag but relatively easy opening when desired by manipulation of the pull flanges 14 and 15.

It will be understood that variations and modifications may be effected without departing from the spirit and scope of the novel concepts of this invention.

I claim as my invention:

1. For a reclosable bag having a pouch body including opposite wall panels with inside surfaces facing toward each other and extending between a bottom edge, opposite sides and an openable top, a reclosably separable fastener assembly adapted to be attached to said surface at the upper portions of said wall panels and associated with upwardly extending pull flanges for separating said fastener assembly to gain downward access to the inside of the bag, said fastener assembly comprising two complementary interengaging sets of spaced parallel, rib-like resiliently flexible extruded plastic separable fastener profile elements providing with interlockable hooks arranged to extend across said wall panels at said inside surfaces and between said side edges, and with a first set on one of said wall panels and a second set on the other wall panel; each of said sets of fastener profile elements having a plurality of said rib like profile elements and a plurality of complementary intervening grooves for receiving the rib like profile elements of the other set in separably interlocking relation, and said profile elements of each set being especially cooperatively related to the other set for mutually facilitating alignment and interlocking closure interengagement by closing pressure applied from outside of the bag wall panels toward said fastener assembly; lower cooperative portions of said sets of fastener profile elements having means for strong resistance to opening from the inside of the bag and upper cooperative portions of said sets of fastener profile elements being arranged for relatively easier opening from the top of the bag by separating manipulation of pull flanges extending thereabove; said first set of fastener profile elements including a first monohook profile element having thereon an interlockable hook directed generally upwardly and having a back surface facing downwardly, said second set of fastener profile elements including a second monohook profile element having thereon an interlockable look directed generally downwardly and having a back surface facing upwardly and located in back-to-back facing relation to said back surface of said first monohook element, said first set of profile elements including a male profile element of generally arrow shape cross-section located in downwardly spaced relation from said first monohook profile element and having an upwardly directed hook on an upper side and a downwardly directed hook on a lower side, said second monohook profile element adapted for interhooking engagement of the hook thereon with said upwardly directed hook of said male profile element, said second set of profile elements including a monohook profile element below said male profile element and having a hook directed generally upwardly and interlockingly engageable with said downwardly directed hook of said male profile element, and said second set of profile elements having another monohook profile element above said second monohook profile element and with a downwardly directed hook interlockingly engageable with said hook of said first monohook profile element.

2. A fastener assembly for a reclosable bag according to claim 1, wherein the downwardly directed hook of said male profile element is of greater mass than the upwardly directed hook of said male profile element, and providing enhanced resistance to separation from said monohook profile element below the lower side of said male profile element, for assurance against separation due to pressure from inside the bag.

3. A fastener assembly for a reclosable bag according to claim 2, wherein the hook of said monohook profile element below said male profile element is of greater mass than the hook of said second monohook profile element.

4. A reclosable bag having a pouch body including opposite wall panels with inside surfaces facing toward each other and extending between a bottom edge, opposite side edges and an openable top, a reclosably separable fastener assembly attached to said surfaces at the top portions of said wall panels, and said fastener assembly comprising:

interengaging complementary first and second sets of fastener profiles;

said first set including a double hook asymmetrical arrow-shaped profile element, and a monohook profile element spaced upwardly from said double hook profile element, each of said profile elements having a hook directed upwardly, said arrow shaped profile element having a larger lower side hook than the upwardly directed hook thereon;

said second set providing a groove-shaped formation for receiving said arrow-shaped fastener profile element and having opposed upper and lower hooks which are complementary to and separably interengageable with said hooks of said arrow-shaped fastener profile element, and a monohook profile element located above said groove-shaped fastener formation and having a hook directed downwardly to engage said hook of said monohook profile element of said first set; and said groove-shaped fastener formation having a surface which faces upwardly and is in face-to-face relation to a surface facing downwardly on said monohook profile element of said first set.

5. A reclosable bag according to claim 4, wherein said first set of profile elements includes a stabilizing flange element located above said monohook profile element of said first set and defining therewith a groove receptive of said monohook profile element of said second set in the assembled relation of said sets of fastener profiles.

6. A reclosable bag according to claim 4, wherein said first set of profile elements has two hooks directed upwardly and one hook directed downwardly, and said second set of profile elements has two hooks directed downwardly one hook directed upwardly.

7. A reclosable bag according to claim 4, wherein the lower hook of said groove-shaped formation is of greater mass than said upper hook of the groove-shaped formation.

8. A reclosable bag having a pouch body including opposite wall panels having inside surfaces facing toward each other and extending between a bottom edge, opposite side edges and an openable top of the body, a reclosably separable fastener assembly attached to said surfaces at the top portions of said wall panels, said fastener assembly comprising:

a combination of a first set of resiliently flexible extruded plastic separable fastener profile elements on one of said wall panels and projecting toward the other of said wall panels, and a cooperating complementary second set of resiliently flexible extruded plastic separable fastener profile elements on said other wall panel projecting toward said one wall panel and aligned with respect to said first set, and all of said profile elements extending lengthwise across said wall panels between said side edges;

said fastener profile sets being especially cooperatively related for mutually facilitating alignment and interlocking closure interengagement of the fastener assembly by closing pressure applied from the outside of the wall panels toward said fastener profile sets;

said first fastener profile set including a male profile element of multi-hook arrow shape cross-section and received between a pair of complementary upper and lower monohook female profile elements of said second fastener profile set, said male profile element and said female profile elements having respective complementary interlockable hooks;

said upper female profile element having an upwardly facing back surface;

the cooperating hooks of said lower female element and of said male profile element being constructed for effectively resisting opening from their interlocking interengagement by separating forces exerted on said wall panels from inside said bag body; and said fastener profile sets having additional complementary monohook profile elements located above said male and female profile elements;

one of said monohook profile elements of said first fastener profile set projecting in overlying relation to said upper female profile element and having a downwardly facing back surface in back-to-back relation to said back surface of said upper female profile element; and said monohook profile elements of both of said sets being mutually interlockingly engageable and adapted for relatively easy opening separation from their interlocking interengagement by bag opening manipulation of said pull flanges, so that when said pull flanges are pulled apart the interlocking monohook profile elements will be separated initially and then by further pulling apart of pull flanges the interlocking male and female profile elements will be separated for access through said bag top to the interior of the bag.

9. A fastener assembly adapted for use with a reclosable bag having a pouch body including opposite wall panels with inside surfaces facing toward each other and extending between a bottom edge, opposite side edges and an openable top, a fastener assembly adapted to be attached to said surfaces at the top portion of said wall panels, and said fastener assembly comprising:

interengaging first and second sets of fastener profiles;

said first set including a double hook asymmetrical arrow-shaped profile element, and a monohook profile element spaced upwardly from said double hook profile element, each of said profile elements having a hook directed upwardly, said arrow shaped profile element having thereon a larger hook on its lower side hook than the upwardly directed thereon;

said second set providing a groove-shaped fastener profile formation having upper and lower portions comprising profile elements for receiving said arrow-shaped fastener profile element therebetween and having opposed hooks which are complementary to and separably interengageable with said hooks of said arrow-shaped fastener profile element, and a monohook profile element of said second set located above said groove-shaped fastener profile formation and having a hook directed downwardly to engage said hook of said monohook profile element of said first set; and said upper portion profile element of said groove-shaped fastener profile formation having a surface which faces upwardly and is in face-to-face relation to a surface facing downwardly on said monohook profile element of said first set.

10. A fastener assembly according to claim 9, wherein said lower portion of said groove-shaped fastener profile formation has a greater mass than said upper portion of said groove-shaped formation.

11. A fastener assembly according to claim 10, wherein said lower portion profile element of said groove-shaped formation is of monohook curved cross-section form.

12. A fastener assembly according to claim 11, wherein all of the fastener profile elements, except said profile element of curved cross-section form, have a substantially straight cross-section except for their respective hooks.

13. A fastener assembly according to claim 9, wherein said first set includes a stabilizer flange profile overlying said monohook profile element of said second set.

14. The fastener assembly according to claim 4, wherein said fastener assembly is integrally extruded with said wall panels.

15. The fastener assembly according to claim 8, wherein said fastener assembly is integrally extruded with said wall panels.

16. The fastener assembly according to claim 9, wherein said fastener assembly is integrally extruded with said wall panels.

* * * * *